US010066447B2

(12) United States Patent
Thomas

(10) Patent No.: US 10,066,447 B2
(45) Date of Patent: Sep. 4, 2018

(54) SYSTEMS AND METHODS FOR RELEASING A TOOL STRING

(71) Applicant: Halliburton Energy Services, Inc., Houston, TX (US)

(72) Inventor: Sean Gregory Thomas, Allen, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 465 days.

(21) Appl. No.: 14/365,693

(22) PCT Filed: May 16, 2013

(86) PCT No.: PCT/US2013/041316
§ 371 (c)(1),
(2) Date: Jun. 16, 2014

(87) PCT Pub. No.: WO2014/185912
PCT Pub. Date: Nov. 20, 2014

(65) Prior Publication Data

US 2015/0345231 A1 Dec. 3, 2015

(51) Int. Cl.
*E21B 17/06* (2006.01)
*E21B 47/00* (2012.01)
(Continued)

(52) U.S. Cl.
CPC ..... *E21B 17/06* (2013.01); *E21B 23/14* (2013.01); *E21B 47/0006* (2013.01); *E21B 47/122* (2013.01)

(58) Field of Classification Search
CPC ..... E21B 17/06; E21B 47/122; E21B 23/14; E21B 47/0006
See application file for complete search history.

(56) References Cited

U.S. PATENT DOCUMENTS 3,260,202 A * 7/1966 Bryla ..... F42D 1/04 102/275.5
3,895,829 A 7/1975 Manson, Jr.
(Continued)

FOREIGN PATENT DOCUMENTS

WO 2014185912 A1 11/2014

OTHER PUBLICATIONS

Clemens et al., "New Slickline Smart-Release Tool Mitigates Wire-Recovery Issues in Extreme Well Conditions," SPE 124966, 2009.
(Continued)

*Primary Examiner* — Taras P Bemko
*Assistant Examiner* — Manuel C Portocarrero
(74) *Attorney, Agent, or Firm* — McDermott Will & Emery LLP

(57) ABSTRACT

Disclosed is a release tool used to separate portions of a tool string. One release tool includes a main body, a collet retainer coupled to the main body and having a collet assembly arranged therein, the collet assembly being operatively coupled to a lower sub, a support piston releasably coupled to a separation nut and engaging the collet assembly such that the lower sub is prevented from removal from the collet assembly, and a trigger mechanism configured to send a command signal to the separation nut whereupon the separation nut releases the support piston such that it is able to be moved and the lower sub is thereby able to be removed from the collet assembly.

20 Claims, 3 Drawing Sheets

(51) Int. Cl.
*E21B 47/12* (2012.01)
*E21B 23/14* (2006.01)

(56) References Cited

U.S. PATENT DOCUMENTS

| | | | | |
|---|---|---|---|---|
| 5,323,853 | A | 6/1994 | Leismer et al. | |
| 5,568,836 | A | 10/1996 | Reid | |
| 6,709,073 | B2 * | 3/2004 | Riddiford | B60T 7/042 303/115.2 |
| 7,373,974 | B2 | 5/2008 | Connell et al. | |
| 8,230,932 | B2 | 7/2012 | Ratcliffe et al. | |
| 2002/0080547 | A1 * | 6/2002 | Rudoy | B64G 1/222 361/161 |
| 2006/0131011 | A1 | 6/2006 | Lynde et al. | |
| 2008/0099210 | A1 * | 5/2008 | Gazewood | E21B 17/06 166/377 |
| 2010/0319930 | A1 | 12/2010 | Evans | |
| 2012/0145396 | A1 * | 6/2012 | Fisher | E21B 17/023 166/301 |
| 2014/0034311 | A1 * | 2/2014 | Lirette | E21B 4/02 166/285 |

OTHER PUBLICATIONS

Berk, Josph, Reliability Comparison, Hi-Shear Technology Corporation, Feb. 18, 2008.
International Search Report and Written Opinion for PCT/US2013/041316 dated Feb. 24, 2014.

* cited by examiner

SYSTEMS AND METHODS FOR RELEASING A TOOL STRING

BACKGROUND

The present disclosure is related to downhole tools used in the oil and gas industry and, in particular, to a release tool used to separate portions of a tool string.

Hydrocarbons are typically produced from wellbores drilled from the Earth's surface through a variety of producing and non-producing subterranean zones. The wellbore may be drilled substantially vertically or may be drilled as an offset well that has some amount of horizontal displacement from the surface entry point. A variety of servicing operations may be performed in the wellbore after it has been drilled and completed by lowering different kinds of downhole tools into the wellbore. For example, a tool string containing measuring instruments are commonly lowered into the wellbore to obtain various downhole measurements, such as bottom hole pressure and temperature. Various sampling devices are also commonly lowered into the wellbore in the tool string to obtain fluid samples at various target zones of the subterranean formation in order to determine the exact composition of the formation fluids of interest.

Such servicing operations are typically undertaken by lowering the tool string and its various downhole tools into the wellbore on a tension member conveyance, such as wireline or slickline. After the wellbore servicing operation is completed, the downhole tool is withdrawn from the wellbore and the slickline is re-coiled back onto an adjacent wire spool or drum. During its ascent to the surface, the tool string can sometimes become stuck due to differential sticking, key seating, hole sloughing, debris lodged in the wellbore, and other common wellbore conditions. In such situations, the tool string can oftentimes be freed through the application of ordinary tensile or compressive forces delivered to the tool string from the surface.

In other situations, however, the conveyance line must be severed from the tool string by introducing a cutting tool into the wellbore. The cutting tool is typically attached to the conveyance and allowed to slide down the conveyance as it is dropped from the surface. Upon contacting or striking the top of the tool string, the cutting tool may be configured to cut the conveyance such that the upper portions of the conveyance line may be retrieved to the surface. Oftentimes the cutting tool prematurely cuts the conveyance upon striking a restriction at some distance above the tool string within the wellbore. This will often leave a long length of conveyance line remaining above the tool string that requires fishing operations that could result in considerable added expense. The fishing job could very well require coiled tubing or tubing fishing which, in addition to service costs, could result in days or weeks of lost rig time and lost production.

SUMMARY OF THE DISCLOSURE

The present disclosure is related to downhole tools used in the oil and gas industry and, in particular, to a release tool used to separate portions of a tool string.

In some embodiments, a release tool is disclosed that may include a main body, a collet retainer coupled to the main body and having a collet assembly arranged therein, the collet assembly being operatively coupled to a lower sub, a support piston releasably coupled to a separation nut and engaging the collet assembly such that the lower sub is prevented from removal from the collet assembly, and a trigger mechanism configured to send a command signal to the separation nut whereupon the separation nut releases the support piston such that it is able to be moved and the lower sub is thereby able to be removed from the collet assembly.

In other embodiments, a method of separating a tool string is disclosed. The method may include conveying the tool string into a wellbore, the tool string including a release tool having a main body coupled to a collet retainer that has a collet assembly arranged therein, the collet assembly being operatively coupled to a lower sub and prevented against removal therefrom with a support piston releasably coupled to a separation nut, activating a trigger mechanism arranged within the release tool, the trigger mechanism being communicably coupled to the separation nut, sending a command signal to the separation nut with the trigger mechanism and thereby releasing the support piston from the separation nut, and axially moving the support piston such that the lower sub is able to be removed from the collet assembly.

The features of the present disclosure will be readily apparent to those skilled in the art upon a reading of the description of the embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure is related to downhole tools used in the oil and gas industry and, in particular, to a release tool used to separate portions of a tool string.

Disclosed are systems and methods of separating a tool string within a wellbore. This may prove advantageous in the event the tool string becomes stuck or otherwise unable to be retrieved to the surface during a wellbore operation. Those skilled in the art will readily appreciate, however, that the disclosed systems and methods may equally be used in cases when the tool string is not stuck but separation is nonetheless desired.

The tool string may include a release tool that has a trigger mechanism arranged therein. Upon actuation, the trigger mechanism may be configured to send a command signal to a separation nut, which releases a support piston and thereby effectively allows the release tool to separate upper portions of the tool string from stuck lower portions. As least one advantage of the presently disclosed systems and methods is that the release tool requires no manual manipulation or intervention from the surface in order to separate the tool string. Moreover, the release tool uses a collet assembly that greatly improves tool wear and overall strength in view of prior release tools that employ dogs or the like. The release tool also uses stored energy from a spring or other biasing device, thereby not being entirely dependent on excessive line tension as applied through the conveyance. Regardless of well depth, deviation or other well parameters, the separation of the tool string can occur at or near the top of the tool string, and an internal fish neck remains in the well for future fishing operations. Moreover, in the event the release tool activates within the well, it can be reused, but it first must be disassembled and reassembled.

Figure 1:
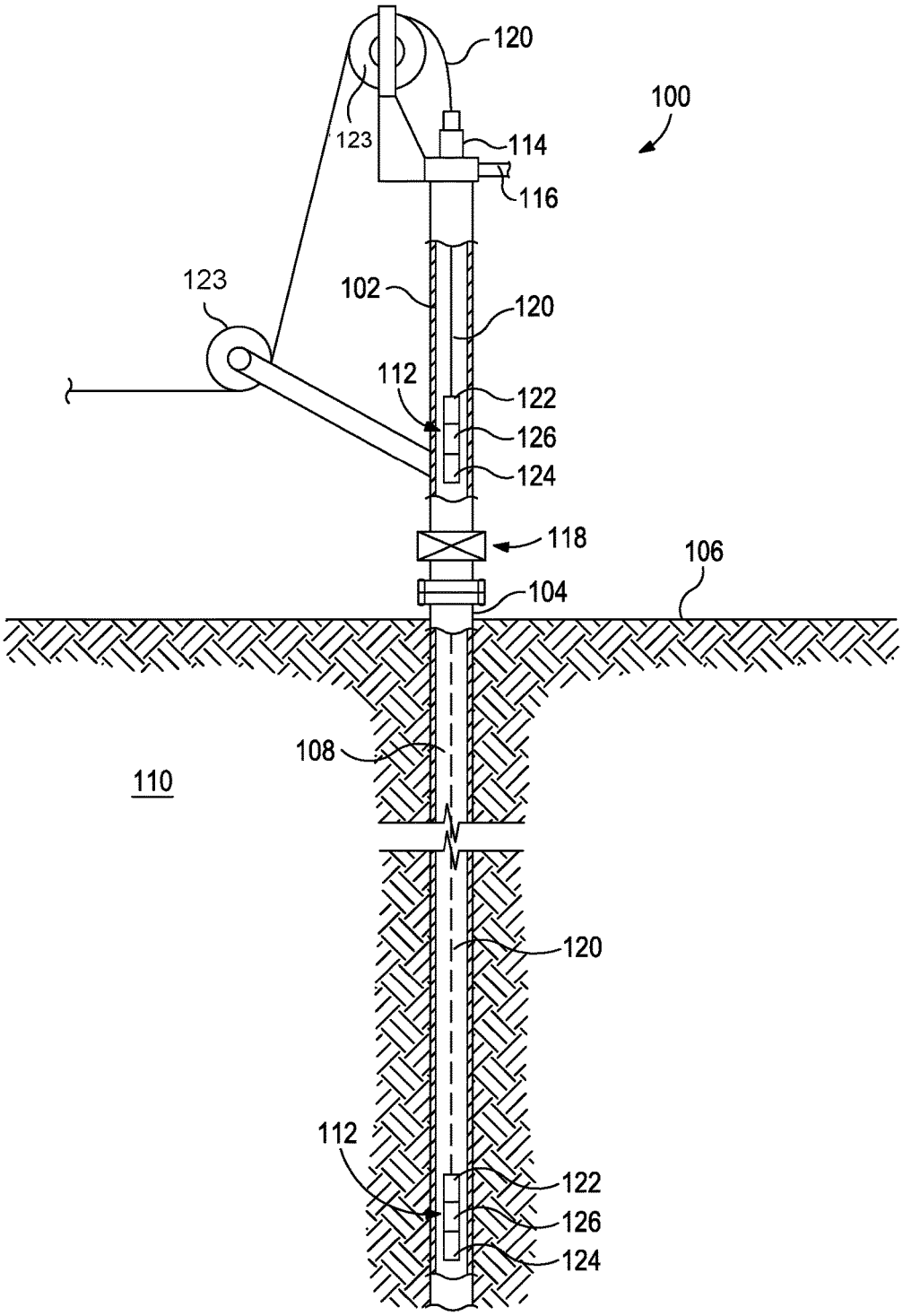
FIG. 1 is a wellbore system that embodies the principles of the present disclosure, according to one or more embodiments.

Referring to FIG. 1, illustrated is an exemplary wellbore system 100 that may embody one or more principles of the present disclosure, according to one or more embodiments. The system 100 may include a lubricator 102 operatively coupled to a wellhead 104 installed at the surface 106 of a wellbore 108. As illustrated, the wellbore 108 extends from the surface 106 and penetrates a subterranean formation 110 for the purpose of recovering hydrocarbons therefrom. While shown as extending vertically from the surface 106 in FIG. 1, it will be appreciated that the wellbore 108 may equally be deviated, horizontal, and/or curved over at least some portions of the wellbore 108, without departing from the scope of the disclosure. The wellbore 108 may be cased, open hole, contain tubing, and/or may generally be characterized as a hole in the ground having a variety of shapes and/or geometries as are known to those of skill in the art. Furthermore, it will be appreciated that embodiments disclosed herein may be employed in surface (e.g., land-based) or subsea wells, without departing from the scope of the disclosure.

The lubricator 102 may be coupled to the wellhead 104 using a variety of known techniques, such as a clamped or bolted connection. Additional components (not shown), such as a tubing head and/or adapter, may be positioned between the lubricator 102 and the wellhead 104. The lubricator 102 may be an elongate, high-pressure pipe or tubular configured to provide a means for introducing a tool string 112 into the wellbore 108 in order to undertake a variety of servicing operations within the wellbore 108. The top of the lubricator 102 may include a stuffing box 114 fluidly coupled to a high-pressure grease-injection line 116 used to introduce grease or another type of sealant into the stuffing box 114 in order to generate a seal. The lower part of the lubricator 102 may include one or more valves 118, such as an isolating valve or swab valve.

The tool string 112 may be attached to the distal end of a wellbore conveyance 120 that is extended into the lubricator 102 via the stuffing box 114.The conveyance 120 may be, but is not limited to, wireline, slickline, electric line (i.e., e-line), jointed tubing, coiled tubing, or the like. The conveyance 120 may be used to transport the tool string 112 into the wellbore 108 such that the desired wellbore servicing operations can be undertaken. The conveyance 120 is generally fed to the lubricator 102 from a spool or drum (not shown) and through one or more sheaves 123 before being introduced into the stuffing box 114 which provides a seal about the conveyance 120 as it slides into the lubricator 102. Those skilled in the art will readily recognize that the arrangement and various components of the lubricator 102 and the wellhead 104 are described merely for illustrative purposes and therefore should not be considered limiting to the present disclosure.

The tool string 112 may include a rope socket 122, a stem 124, and a release tool 126 operatively coupled to and otherwise interposing the rope socket 122 and the stem 124. While depicted in FIG. 1 in a particular configuration, those skilled in the art will readily appreciate that the arrangement of the rope socket 122, the stem 124, and the release tool 126 in the tool string may vary, depending on the application. The rope socket 122 may be used to attach the conveyance 120 to the tool string 112, and the stem 124 may contain or otherwise include one or more downhole tools used to undertake the various wellbore servicing operations once the tool string 112 is located downhole. As described in greater detail below, the release tool 126 may include an automatic-release mechanism configured to release upper portions of the tool string 112 in the event the tool string 112 becomes stuck in the wellbore 108 or otherwise when separation is nonetheless desired without a stuck tool string 112. Upon separation, the conveyance 120 may be returned to the surface 106 while the remaining lower portions of the tool string 112 are left downhole to be fished out later with more robust wellbore equipment.

Even though FIG. 1 depicts the tool string 112 as being extended into a substantially vertical portion of the wellbore 108, it will be appreciated by those skilled in the art that the embodiments disclosed herein are equally well suited for use in horizontal wellbores, deviated wellbores, slanted wellbores, diagonal wellbores, combinations thereof, and the like. Use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Moreover, as used herein, the term "proximal" refers to that portion of the component being referred to that is closest to the wellhead, and the term "distal" refers to the portion of the component that is furthest from the wellhead.

Figure 2A:
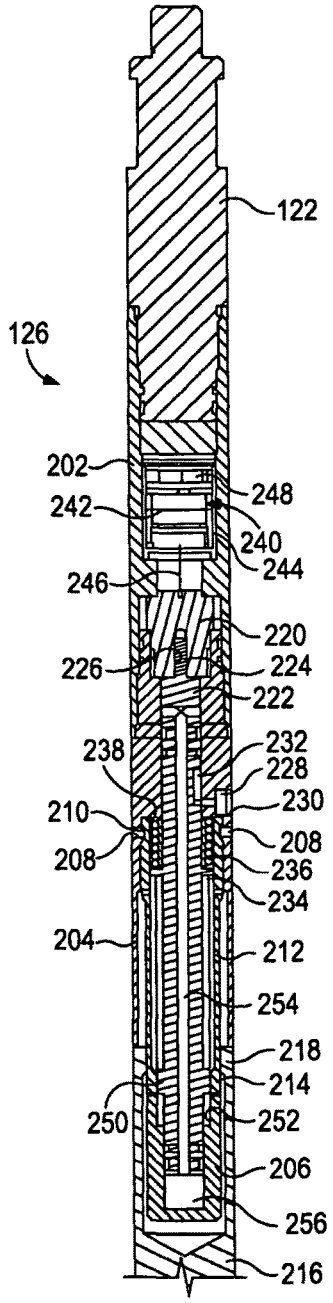
FIGS. 2A and 2B illustrate partial cross-sectional views of an exemplary release tool in its secured and released configurations, respectively, according to one or more embodiments.
Figure 2B:
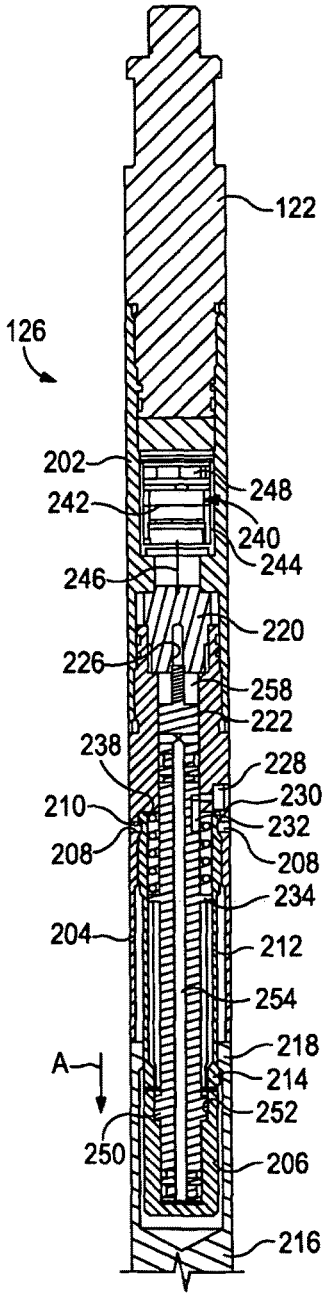

Referring now to FIGS. 2A and 2B, with continued reference to FIG. 1, illustrated are partial cross-sectional views of the release tool 126, according to one or more embodiments. In particular, FIG. 2A depicts the release tool 126 in a secured configuration and FIG. 2B depicts the release tool 126 in a released configuration. The release tool 126 may include a main body 202 coupled or otherwise attached to the rope socket 122 at its proximal end. At its distal end, the main body 202 may be coupled or otherwise attached to a collet retainer 204 that extends axially therefrom. In some embodiments, the main body 202 may be threaded to one or both of the rope socket 122 and the collet retainer 204. In other embodiments, however, the main body 202 may be mechanically fastened to one or both of the rope socket 122 and the collet retainer 204 using, for example, one or more bolts, screws, shear pins, shear rings, collets, or a combination thereof.

The collet retainer 204 may have a collet assembly 206 generally arranged therein. The collet assembly 206 may be threaded to the collet retainer 204 and one or more set screws may be extended through corresponding perforations 208 (two shown) defined in the collet retainer 204 in order to prevent the collet assembly 206 from backing out. As illustrated, the one or more set screws may mate with or otherwise be seated within a groove 210 defined in the collet assembly 206 and thereby prevent the removal of the collet assembly 206 out the distal end of the collet retainer 204.

The collet assembly 206 may include a plurality of axially extending fingers 212, each having a radial protrusion 214 (one shown) defined at its distal end. The radial protrusions 214 may be operable to couple the collet assembly 206 to a lower sub 216 that extends axially in the downhole or distal direction from the lower end of the release tool 126. The lower sub 216 may form part of the stem 124 of FIG. 1 and may otherwise be characterized or referred to as a lower "fish neck," as generally known to those skilled in the art. More particularly, the lower sub 216 may be referred to as an internal fish neck that is capable of being attached to during fishing operations. While not shown, the lower fish neck or sub 216 may facilitate coupling of the release tool 126 to the remaining lower portions of the tool string 112 (FIG. 1), including the downhole tools of the stem 124.

The lower sub 216 may define or provide a profile 218 configured to matingly engage the radial protrusions 214 of the fingers 212. In some embodiments, the profile 218 may be an annular protrusion, as illustrated. In other embodiments, however, the profile 218 may be an annular groove, or the like, defined on the inner radial surface of the lower sub 216, without departing from the scope of the disclosure. As long as the radial protrusions 214 maintain engagement with the profile 218, the collet assembly 206 will be effectively coupled to the lower sub 216.

The release tool 126 may further include a separation nut 220 releasably coupled or otherwise attached to a support piston 222 that extends longitudinally within the release tool 126. In some embodiments, the separation nut 220 may be arranged at least partially within the main body 202, as illustrated. In other embodiments, however, the separation nut 220 may be arranged at least partially within one or both of the main body 202 and the collet retainer 204. The support piston 222 may be a generally elongate rod movably arranged at least partially within both the collet retainer 204 and the collet assembly 206.

The support piston 222 may include an axial extension 224 arranged at and otherwise axially extending upward from the upper end of the support piston 222. The separation nut 220 may define a hole 226 configured to receive and secure the axial extension 224 from removal. In some embodiments, the axial extension 224 may be threaded into the hole 226. In order to prevent inadvertent unthreading of the axial extension 224 from the hole 226, a set screw 228 or the like may be extended through a perforation 230 defined in the collet retainer 204. The set screw 228 may be configured to extend into a longitudinal slot or groove 232 defined in the outer surface of the support piston 222, and thereby secure the support piston 222 against inadvertent freewheeling or rotational movement. As a result, the axial extension 224 may be prevented from removal from the hole 226 by rotational unthreading.

The support piston 222 may further define a radial shoulder 234 at an intermediate location along its axial length. At least one biasing device 236 may be arranged between the radial shoulder 234 and an end wall 238 of the collet retainer 204 and configured to bias the support piston 222 in the downward direction (i.e., in the direction of arrow A of FIG. 2B). In some embodiments, the biasing device 236 may be a compression spring, as generally illustrated. In other embodiments, however, the biasing device 236 may be a series of Belleville washers, or the like. As shown in FIG. 2A, the biasing device 236 is in a compressed configuration. In FIG. 2B, the biasing device 236 is depicted in an expanded configuration after having forced or moved the support piston 222 in the downward direction A.

The separation nut 220 may be configured maintain the biasing device 236 in the compressed configuration by axially securing the support piston 222 in place via the axial extension 224. According to the present disclosure, however, the separation nut 220 may be configured to release the support piston 222 upon the receipt of an electrical command signal, thereby freeing the biasing device 236 such that it is able to move to its expanded configuration and simultaneously move the support piston 222 in the downward direction A.

In some embodiments, the separation nut 220 may be, or otherwise may be configured as, a fusible link separation nut based on split-spool technology. As known to those skilled in the art, fusible link separation nuts are electro-mechanical devices that include a fuse wire wrapped multiple times around a structural body. The fuse wire maintains or holds two or more separable portions of the structural body (i.e., the "split-spool") intact as a single structural element. Upon receipt of an electrical charge at a predetermined amount of current, the fuse wire may be configured to breaks or otherwise fail, thereby allowing the two or more separable portions of the body to separate and release a load held in tension by the body. In the present embodiment, the tensile load supported by the separation nut 220 is the support piston 222 via the axial extension 224 as threadably secured thereto at the hole 226. Once the separation nut 220 receives the command signal in the form of an electrical charge at the predetermined amount of current, the fuse wire (not shown) holding the separation nut 220 intact may be broken, thereby freeing the axial extension 224 from engagement within the hole 226.

In other embodiments, the separation nut 220 may be any other device or mechanism configured to release the support piston 222 (via the axial extension 224) from engagement with the separation nut 220 upon receipt of the command signal. For example, in some embodiments, the separation nut 220 may be a pyrotechnic separation fastener having at least one charge arranged therein that is configured to detonate upon receipt of the command signal. Once detonated, the axial extension 224 may be freed from engagement with the hole 226, thereby allowing the support piston 222 to move in the direction A as forced by the biasing device 236.

In yet other embodiments, the separation nut 220 may be simply backed off (i.e., unthreaded) from engagement with the axial extension 224. In such embodiments, the separation nut 220 may be operatively coupled to a motor or some type of electro-mechanical device (not shown) configured to unthread the separation nut 220 from the axial extension, thereby allowing the support piston 222 to move in the direction A as biased by the biasing device 236. The motor or electro-mechanical device may be any mechanical, electro-mechanical, hydro-mechanical, hydraulic, or pneumatic device configured to produce mechanical motion.

The release tool 126 may further include a trigger mechanism 240 configured to send the command signal to the separation nut 220 in order to trigger the release of the support piston 222. The trigger mechanism 240 may include a power source 242 configured to provide power to the trigger mechanism 240. The power source 242 may be one or more batteries or fuel cells, such as alkaline or lithium batteries. In other embodiments, the power source 242 may be a terminal portion of an electrical line (i.e., e-line) extending from the surface 106 (FIG. 1) or otherwise any type of device capable of providing power to trigger mechanism 240 such that it may send the command signal. In yet other embodiments, the power source 242 may encompass power or energy derived from a downhole power generation unit or assembly, as known to those skilled in the art.

In some embodiments, the trigger mechanism 240 may be generally arranged within a trigger housing 244 disposed within the main body 202 of the release tool 126. As illustrated, the trigger mechanism 240 may be communicably coupled to the separation nut 220 via one or more signal lines 246. The signal line 246 may be an electrical line or wire capable of delivering the command signal in the form of an electrical charge of a predetermined amount of current to the separation nut 220.

The trigger mechanism 240 may be any device or system configured to send the command signal to the separation nut 220 upon activation. In some embodiments, for example, the trigger mechanism 240 may encompass or otherwise include radio frequency (RF) technology. For instance, the trigger mechanism 240 may include an RF receiver (not shown) configured to be activated upon electromagnetic interaction with an RF transmitter (not shown) sent downhole from the surface 106 (FIG. 1). Once activated, the RF receiver may be configured to send the command signal to the separation nut 220.

In other embodiments, the trigger mechanism 240 may be an accelerometer (not shown) or a strain gauge configured to monitor impact loads and/or tensile stress in the tool string 112 (FIG. 1) and/or in the conveyance 120 (FIG. 1). In such embodiments, the trigger mechanism 240 may be activated upon experiencing or registering a predetermined impact loading, a predetermined tensile load, or a predetermined pattern or series of jars as applied from the surface 106 (FIG. 1). Once the predetermined impact load, tensile load or pattern of jars is sensed, the trigger mechanism 240 may be configured to send the command signal to the separation nut 220 in order to release the support piston 222 therefrom. As will be appreciated, in such embodiments, the trigger mechanism 240 may include various processing devices and/or systems, such as a signal processer, in order to carry out its desired operation.

In yet other embodiments, as illustrated, the trigger mechanism 240 may be a timer or timing device 248. The timer 248 may be, but is not limited to, a mechanical timer, an electro-mechanical timer, an electronic timer, a computer timer, any combination thereof, or the like. The timer 248 may be installed in the trigger housing 244 at the surface 106 (FIG. 1) and configured or otherwise set such that it counts down from a predetermined or specified time interval at which point the timer 248 may be activated and otherwise configured to send the command signal to the separation nut 220.

The predetermined time interval may be configured to span a time period within which a particular wellbore operation is to be performed. The timing for accomplishing a wellbore operation includes the time required to convey the tool string 112 into the wellbore 108 to a target location, perform the operation while at the target location, and retrieve the tool string 112 to the surface 106 following completion of the wellbore operation. If the tool string 112 becomes stuck within the wellbore 108 while performing the wellbore operation or while ascending to the surface 106, expiration of the predetermined time interval will activate the trigger mechanism 240 such that the command signal is sent to the separation nut 220. As described in greater detail below, once the separation nut 220 is triggered and releases the support piston 222, the upper portions of the tool string 112 may be separated from the lower stuck portions such that the upper portions may be retrieved to the surface 106.

In some cases, for example, a particular wellbore operation may typically require around three hours to complete the assigned task. In such cases, the timer 248 may be set with a predetermined time interval of about six hours, thereby providing more than sufficient time to perform the required wellbore operation. This also provides a known time limit when the components of the release tool 126 will be activated to separate the tool string 112 in the event the tool string 112 becomes stuck while downhole. In cases where the tool string 112 is returned to the surface 106 before the predetermined time interval is reached or otherwise spent, the release tool 126 may be disassembled and the timer 248 may be manually stopped by an operator. In other embodiments, the timer 248 may be automatically or otherwise autonomously stopped upon nearing the surface 106, such as through the use of RF technology or the like.

As will be appreciated, the predetermined time interval may vary depending on the application and the particular wellbore operation or operations that are to be undertaken using the tool string 112. Accordingly, the timer 248 may be set with any predetermined time interval required to successfully accomplish the task at hand. In some embodiments, the predetermined time interval may be set at three hours, six hours, twelve hours, twenty-four hours, or forty-eight hours. In other embodiments, the predetermined time interval may be set at any time before or after three hours and forty-eight hours or any time falling therebetween.

With continued reference to FIGS. 2A-2B and FIG. 1, exemplary operation of the release tool 126 is now provided. As the tool string 112 is conveyed downhole, the release tool 126 may be secured or otherwise coupled to the stem 124 via engagement with the lower sub 216, as generally described above. More particularly, the radial protrusions 214 defined on the axially extending fingers 212 of the collet assembly 206 may be engaged with or otherwise biased against the profile 218 of the lower sub 216. In other embodiments, however, as also mentioned above, the general configuration and arrangement of the release tool 126 with respect to the stem 124 may vary, depending on the application. Accordingly, the embodiment shown in FIGS. 2A-2B and FIG. 1 should not be considered as limiting to the scope of the disclosure and the novel separation capabilities of the release tool 126.

An annular projection 250 may be defined on the support piston 222 and configured to radially bias the radial protrusions 214 into mating engagement with the profile 218 such that the radial protrusions 214 are unable to slip out of engagement with the lower sub 216. In the event the tool string 112 becomes stuck while downhole, or otherwise in the event a separation of the tool string 112 is nonetheless desired, the trigger mechanism 240 may be activated. Activating the trigger mechanism 240 may result in the command signal being sent to the separation nut 208 via the signal line 246. Depending on the type of trigger mechanism 240 being used in the release tool 126, the command signal may be sent to the separation nut 220 following several different scenarios briefly discussed above. Such scenarios may include sending an RF transmitter downhole to interact with an RF receiver associated with the trigger mechanism 240, and monitoring predetermined tensile loads or predetermined patterns or series of jars as applied from the surface 106 with an accelerometer or a strain gauge associated with the trigger mechanism 240.

In other embodiments, the trigger mechanism 240 may include the timer 248 that may transmit the command signal upon expiration of a predetermined time interval programmed into the timer 248 before the tool string 112 is introduced into the wellbore 108. In some embodiments, the timer 248 may be activated or "turned on" while at the surface 106. In other embodiments, the timer 248 may be activated at another location within the wellbore 108. For instance, in at least one embodiment, the timer 248 may be activated by sending another activating device (e.g., RF technology) downhole to interact with the timer 248 once the tool string 112 becomes stuck. In such embodiments, the predetermined time interval may be quite short, such as a few minutes or even instantaneous.

Upon receiving the command signal, the separation nut 220 may be triggered to release the support piston 222. As discussed above, in at least one embodiment the separation nut 220 may be a fusible link separation nut and the command signal may be an electrical charge of a predetermined amount of current supplied to a fuse wire that breaks or otherwise fails upon receiving the current. With the fuse wire broken, the axial extension 224 of the support piston 222 may be released from engagement with the hole 226, thereby allowing the support piston 222 to separate from the separation nut 220. In other embodiments, the separation nut 220 may be a pyrotechnic separation fastener having at least one charge arranged therein configured to detonate upon receipt of the command signal (e.g., an electrical charge or signal), and thereby allowing the support piston 222 to separate from the separation nut 220. In yet other embodiments, the separation nut 220 may be operatively coupled to a motor or electro-mechanical device that simply backs off (i.e., unthreads) the separation nut 220 from engagement with the axial extension 224.

Once free from engagement with the separation nut 220, the stored spring force of the one or more biasing devices 236 may be free to move from its compressed configuration into its expanded configuration and in the process force the support piston 222 in the direction A, as shown in FIG. 2B. Moving the support piston 222 in the direction A also moves the annular projection 250 out of biasing engagement with the plurality of fingers 212 as the annular projection moves axially downward and into a groove 252 defined on the inner radial surface of the collet assembly 206.

In some embodiments, the support piston 222 may have an internal fluid conduit 254 defined therein along substantially its entire length. As the support piston 222 moves in the direction A, the fluid conduit 254 may be configured to channel air or other fluids from a first chamber 256 (FIG. 2A) defined below the support piston 222 in the collet assembly 206 into a second chamber 258 that is gradually formed above the support piston 222. Without the fluid conduit 254, the support piston 222 would otherwise be required to fight against hydrostatic fluid pressure above and below the support piston 222 that may hinder the axial movement of the support piston 222.

Figure 3:
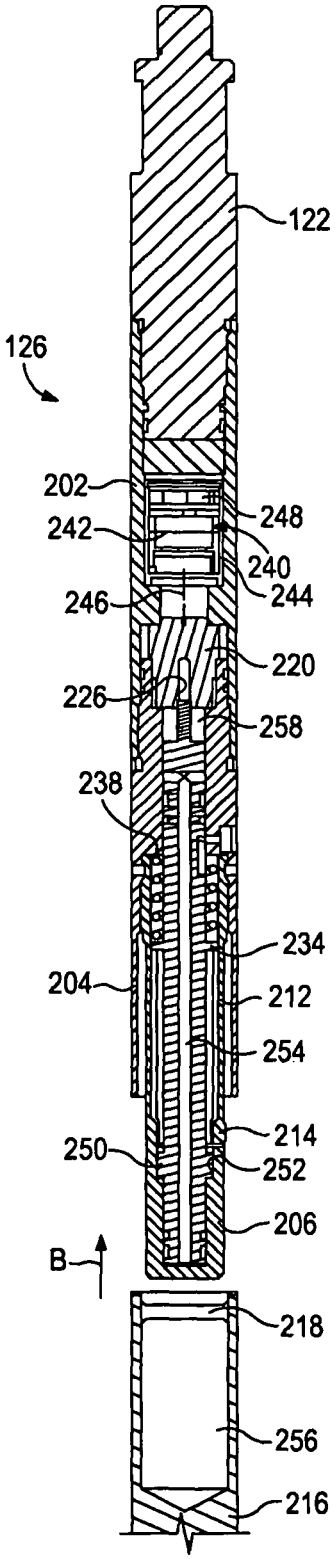
FIG. 3 illustrates the release tool of FIGS. 2A and 2B as separated from a lower sub, according to one or more embodiments.

Referring now to FIG. 3, with continued reference to FIGS. 1 and 2A-2B, illustrated is the release tool 126 as separated from the lower sub 216, according to one or more embodiments. With the annular projection 250 moved out of engagement with the plurality of fingers 212, the release tool 126 may be separated from the lower sub 216 by pulling up on the tool string 112 in the direction B. More particularly, a tensile force in the upward direction B may be applied to the tool string 112 via the rope socket 122 as coupled to the conveyance 120. As the release tool 126 is urged in the direction B, the plurality of fingers 212 may be free to flex inwards and out of engagement with the profile 218, thereby allowing the radial protrusions 214 to slide past and out of engagement with the profile 218. In some embodiments, each of the radial protrusions 214 and the profile 218 may have corresponding beveled surfaces that help facilitate a smoother transition out of engagement as the fingers 212 collapse and/or flex inwards and out of engagement with the profile 218.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A release tool, comprising:

a main body;

a collet retainer coupled to the main body and having a collet assembly arranged therein, the collet assembly being coupled to a lower sub, the collet assembly comprising a radial protrusion that matingly engages a profile defined on the lower sub;

a support piston positioned within the collet assembly to prevent the lower sub from removal from the collet assembly, the support piston comprising an internal conduit along an axial length of the support piston, wherein the support piston defines an annular projection configured to radially bias the radial protrusion into mating engagement with the profile;

a separation nut fixed within the main body and defining a hole that receives an axial extension provided by the support piston, wherein the support piston is releasably coupled to the separation nut at the axial extension; and a trigger mechanism that sends an electrical command signal to the separation nut to release the axial extension such that the support piston is able to move and thereby release the lower sub from the collet assembly, wherein the internal conduit channels air or a fluid from a first chamber defined at a first end of the collet assembly into a second chamber defined at a second end of the collet assembly when the support piston is being moved from the second end to the first end, wherein the annular projection is positioned outside of a groove defined on an inner radial surface of the collet assembly and biases the radial protrusion outward and into mating engagement with the profile to couple the collet assembly with the lower sub when the axial extension is coupled to the separation nut, and wherein the annular projection is positioned into the groove and the radial protrusion is flexed inward and out of mating engagement with the profile that allows the collet assembly to be separated from the lower sub when the axial extension is decoupled from the separation nut.

2. The release tool of claim 1, wherein the collet assembly comprises a plurality of axially extending fingers operable to couple the collet assembly to the lower sub, and wherein at least one of the axially extending fingers comprises the radial protrusion.

3. The release tool of claim 2, wherein the radial protrusion is unable to move out of engagement with the lower sub when the radial protrusion is matingly engaged with the profile.

4. The release tool of claim 1, wherein the axial extension is secured against removal from the hole until the separation nut receives the command signal.

5. The release tool of claim 1, further comprising:

a radial shoulder defined at an intermediate location on the support piston; and at least one biasing device arranged between the radial shoulder and an end wall of the collet retainer, the at least one biasing device being configured to move from a compressed configuration, where the support piston is coupled to the separation nut, and an expanded configuration, where the support piston is released from the separation nut and moved such that the lower sub is able to be removed from the collet assembly.

6. The release tool of claim 1, wherein the separation nut is a fusible link separation nut communicably coupled to the trigger mechanism and configured to break a fuse wire and thereby release the support piston upon receiving the command signal from the trigger mechanism.

7. The release tool of claim 1, wherein the separation nut is a pyrotechnic fastener communicably coupled to the trigger mechanism and configured to detonate upon receiving the command signal from the trigger mechanism.

8. The release tool of claim 1, wherein the trigger mechanism is a timer configured to send the command signal upon expiration of a predetermined time interval.

9. The release tool of claim 1, wherein the trigger mechanism comprises a radio frequency receiver configured to be activated to send the command signal upon electromagnetic interaction with a radio frequency transmitter.

10. The release tool of claim 1, wherein the trigger mechanism comprises at least one of an accelerometer configured to monitor impact loads and a strain gauge configured to monitor tensile stress and send the electrical signal upon registering a predetermined impact load, a predetermined tensile load, or a predetermined pattern or series of jars.

11. A method of separating a tool string, comprising:

conveying the tool string into a wellbore, the tool string including:

a release tool having a main body coupled to a collet retainer that has a collet assembly arranged therein, the collet assembly being operatively coupled to a lower sub, the collet assembly comprising a radial protrusion that matingly engages a profile defined on the lower sub;

a support piston positioned within the collet assembly to prevent the lower sub from removal from the collet assembly, the support piston comprising an internal conduit along an axial length of the support piston, wherein the support piston defines an annular projection configured to radially bias the radial protrusion into mating engagement with the profile; and a separation nut fixed within the main body and defining a hole that receives an axial extension provided by the support piston to releasably couple the support piston to the separation nut, wherein the support piston is releasably coupled to the separation nut at the axial extension;

activating a trigger mechanism arranged within the release tool and communicably coupled to the separation nut;

sending an electrical command signal to the separation nut with the trigger mechanism and thereby releasing the axial extension from the separation nut; and axially moving the support piston such that the lower sub is able to be removed from the collet assembly, wherein the internal conduit channels air or a fluid from a first chamber defined at a first end of the collet assembly into a second chamber defined at a second end of the collet assembly when the support piston is being moved from the second end to the first end, wherein the annular projection is positioned outside of a groove defined on an inner radial surface of the collet assembly and biases the radial protrusion outward and into mating engagement with the profile to couple the collet assembly with the lower sub when the axial extension is coupled to the separation nut, and wherein the annular projection is positioned into the groove and the radial protrusion is flexed inward and out of mating engagement with the profile that allows the collet assembly to be separated from the lower sub when the axial extension is decoupled from the separation nut.

12. The method of claim 11, wherein the collet assembly comprises a plurality of axially extending fingers and at least one of the axially extending fingers has a radial protrusion defined thereon, wherein conveying the tool string into the wellbore comprises:

matingly engaging a profile defined on the lower sub with the radial protrusion; and radially biasing the radial protrusion into mating engagement with the profile with an annular projection defined on the support piston, whereby the radial protrusion is unable to move out of engagement with the lower sub.

13. The method of claim 12, wherein axially moving the support piston comprises:

biasing the support piston with at least one biasing device arranged between a radial shoulder defined at an intermediate location on the support piston and an end wall of the collet retainer; and moving the at least one biasing device from a compressed configuration, where the support piston is coupled to the separation nut, to an expanded configuration, where the support piston is released from the separation nut and moved such that the annular projection is moved out of biasing engagement with the radial protrusion.

14. The method of claim 13, further comprising:

providing a tensile force to the tool string in an upward direction;

flexing the plurality of axially extending fingers inwards and out of engagement with the profile; and separating the release tool from the lower sub by continued tensile force in the upward direction.

15. The method of claim 11, further comprising securing the support piston to the separation nut with the axial extension until the separation nut receives the command signal.

16. The method of claim 11, wherein the separation nut is a fusible link separation nut and sending the command signal to the separation nut comprises:

conveying an electrical charge of a predetermined amount to a fuse wire of the fusible link separation nut; and breaking the fuse wire of the separation nut with the electrical charge such that the support piston is able to be released from the separation nut.

17. The method of claim 11, wherein the separation nut is a pyrotechnic fastener having one or more charges arranged therein and sending the command signal to the separation nut comprises:

conveying an electrical charge to the one or more charges; and detonating the one or more charges with the electrical charge such that the support piston is able to be released from the separation nut.

18. The method of claim 11, wherein the trigger mechanism is a timer and activating the trigger mechanism comprises:

setting the timer with a predetermined time interval; and allowing the predetermined time interval to expire.

19. The method of claim 11, wherein the trigger mechanism comprises a radio frequency receiver and activating the trigger mechanism comprises:

sending a radio frequency transmitter downhole; and electromagnetically interacting the radio frequency transmitter with the radio frequency receiver.

20. The method of claim 11, wherein the trigger mechanism comprises at least one of an accelerometer and a strain gauge and activating the trigger mechanism comprises:

monitoring at least one of impact loads in the tool string with the accelerometer and tensile stresses with the strain gauge in the tool string; and sending the electrical signal upon registering a predetermined impact load, a predetermined tensile load, or a predetermined pattern or series of jars in the tool string.

* * * * *